US009451823B2

(12) United States Patent
McCuistion

(10) Patent No.: US 9,451,823 B2
(45) Date of Patent: Sep. 27, 2016

(54) ADJUSTABLE SHELVING SYSTEM

(71) Applicant: Michael T. McCuistion, Columbia, MO (US)

(72) Inventor: Michael T. McCuistion, Columbia, MO (US)

(73) Assignee: SwingStow, LLC, Columbia, MO (US)

( * ) Notice: Subject to any disclaimer, the term of this patent is extended or adjusted under 35 U.S.C. 154(b) by 0 days.

(21) Appl. No.: 14/644,439

(22) Filed: Mar. 11, 2015

(65) Prior Publication Data

US 2016/0198846 A1 Jul. 14, 2016

Related U.S. Application Data

(63) Continuation-in-part of application No. 14/604,080, filed on Jan. 23, 2015, and a continuation-in-part of application No. 14/592,065, filed on Jan. 8, 2015.

(51) Int. Cl.
*A47B 53/02* (2006.01)
*A47B 46/00* (2006.01)

(52) U.S. Cl.
CPC ..... *A47B 53/02* (2013.01); *A47B 46/00* (2013.01)

(58) Field of Classification Search
CPC .... A47B 53/02; A47B 49/004; A47B 43/00; E05D 3/022; B60B 33/0002; Y10T 16/5327; Y10T 16/5361; Y10T 16/539
USPC ..... 211/150
See application file for complete search history.

(56) References Cited

U.S. PATENT DOCUMENTS 241,123 A * 5/1881 Danner ..... A47B 49/004 312/199
1,241,615 A * 10/1917 Farrow ..... E05G 1/00 109/23
2,373,955 A * 4/1945 Fuller ..... E05D 7/0423 126/194
3,070,416 A * 12/1962 Post ..... A47B 17/00 108/14
4,848,585 A * 7/1989 Snyder ..... A45C 11/16 206/315.11
D372,607 S * 8/1996 Pallas ..... D6/671.1
D629,228 S * 12/2010 Allman ..... D6/680
2002/0180318 A1* 12/2002 Bitner ..... B25H 3/023 312/200

* cited by examiner

*Primary Examiner* — Korie H Chan
(74) *Attorney, Agent, or Firm* — Dale J Ream

(57) ABSTRACT

An adjustable shelving system includes a base member having rear, first, and second sides in a triangular configuration suitable for a room corner. A first shelf assembly is pivotally coupled to the first side of the base member and movable between a first rearward configuration perpendicular to the base member and a first forward configuration offset relative to the rearward configuration. A second shelf assembly is pivotally coupled to the second side of the base member and movable between a second rearward configuration perpendicular to the base member and a second forward configuration offset relative to the rearward configuration. Each shelf assembly includes rollers configured to support the weight of the shelf assembly and enhance movement, especially on an uneven surface. Each shelf assembly may include a vertically floatable hinge configured to allow the shelf assembly to move up or down according to changes in elevation of a floor surface.

16 Claims, 15 Drawing Sheets

ADJUSTABLE SHELVING SYSTEM

REFERENCE TO RELATED APPLICATIONS

The present invention is a continuation-in-part and claims the benefit of U.S. patent application Ser. No. 14/604,080 filed on Jan. 23, 2015 titled Adjustable Shelving System which is a continuation-in-part and claims the benefit of U.S. patent application Ser. No. 14/592,065 filed on Jan. 8, 2015 titled Vertically Floating Hinge, the related application being incorporated herein by reference.

BACKGROUND OF THE INVENTION

This invention relates generally to a shelving system and, more particularly, to an adjustable shelving system having two or more rolling shelf assemblies pivotally coupled to a fixed base member that are movable to desired configurations. The adjustable shelving system includes an embodiment configured for use in the corner of a room where two generally perpendicular walls intersect.

Multiple unit shelving systems, such as may be found in libraries, bookstores, commercial facilities, and even in garages or residential areas are very desirable for holding a high volume of articles such as books, tubs filled with hardware, toys, memorabilia, and much more. Unfortunately, multiple shelving units take up a great deal of space as they must be lined up side by side or spaced apart in parallel alignment such that the front of each unit is accessible. Further, the back of such units are typically not configured to themselves be functional to hold or display items.

Various devices are known in the art that are movable so that they may be stored out of the way until needed. Although assumably effective for their intended use, movable shelf units may be unstable and risk prone to being tipped over which can cause injury to users or damage to goods.

Therefore, it would be desirable to have an adjustable shelving system having multiple shelf assemblies that are pivotally coupled to a base member and movable between forward and rearward configurations so as to be compact when access is not needed and expanded when access is desired. Further, it would be desirable to have an adjustable shelving system in which the shelf assemblies are supported upon rollers that enhance smooth and safe movement of the assemblies. In addition, it would be desirable to have an adjustable shelving system in which shelf assemblies are mounted with vertically flexible hinges that enable a shelf assembly to move up or down with elevation changes in a floor surface such that corresponding rollers maintain contact with the floor to support the weight of the shelf assembly. Still further, it would be desirable to have an adjustable shelving system that is configured to be situated in the corner of a room having generally perpendicular walls that intersect.

SUMMARY OF THE INVENTION

An adjustable shelving system according to the present invention includes a base member having a rear portion, a first side portion, and a second side portion arranged in a triangular configuration suitable for use in a corner of a room (i.e. at an intersection of two generally perpendicular walls. A first shelf assembly is pivotally coupled to the first side of the base member and movable between a first rearward configuration perpendicular to the first side portion of the base member and a first forward configuration offset relative to the rearward configuration. A second shelf assembly is pivotally coupled to the second side portion of the base member and movable between a second rearward configuration perpendicular to the second side portion of the base member and a second forward configuration offset relative to the rearward configuration. Each shelf assembly includes rollers configured to support the weight of the shelf assembly and enhance movement, especially on an uneven surface. Each shelf assembly may include a vertically floatable hinge configured to allow the shelf assembly to move up or down according to changes in elevation of a floor surface.

Each shelf assembly is independently pivotally coupled to the base member. Each shelf assembly includes shelves accessible from a front side and suitable for supporting articles. Each shelf assembly includes a peg board accessible from a back side and suitable for hanging tools and the like. Each shelf assembly includes one or more rollers or wheels configured to support the weight of the shelf assembly and enhance movement between rearward and forward positions. Each shelf assembly may be coupled to the base member with a vertically floatable hinge configured to allow a respective shelf assembly to move up or down according to changes in elevation of a floor surface.

Therefore, a general object of this invention is to provide an adjustable shelving system having at least first and second shelf assemblies pivotally coupled to and movable about a corner-oriented base member between forward and rearward configurations.

Another object of this invention is to provide an adjustable shelving system, as aforesaid, that is configured such that respective shelf assemblies are parallel to adjacent walls of a house or building that are perpendicular and intersect in a corner.

Another object of this invention is to provide an adjustable shelving system, as aforesaid, in which the shelf assemblies are quickly and easily movable between compact storage configurations and expanded access configurations.

Still another object of this invention is to provide an adjustable shelving system, as aforesaid, in which each shelf assembly includes rollers that enhance smooth movement and partially support the weight of the assembly.

Yet another object of this invention is to provide an adjustable shelving system, as aforesaid, in which shelf assemblies are coupled to the base member with vertically adjustable floating hinges that enable the shelf unit to shift upwardly or downwardly according to elevation changes in a floor surface.

A further object of this invention is to provide an adjustable shelving system, as aforesaid, in which the back of each shelf assembly includes a pegboard covering that is configured to hang items such as tools.

A still further object of this invention is to provide an adjustable shelving system, as aforesaid, in which the base member is fixed and stable such that rolling movement, even of heavily laden assemblies, is stable and safe.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
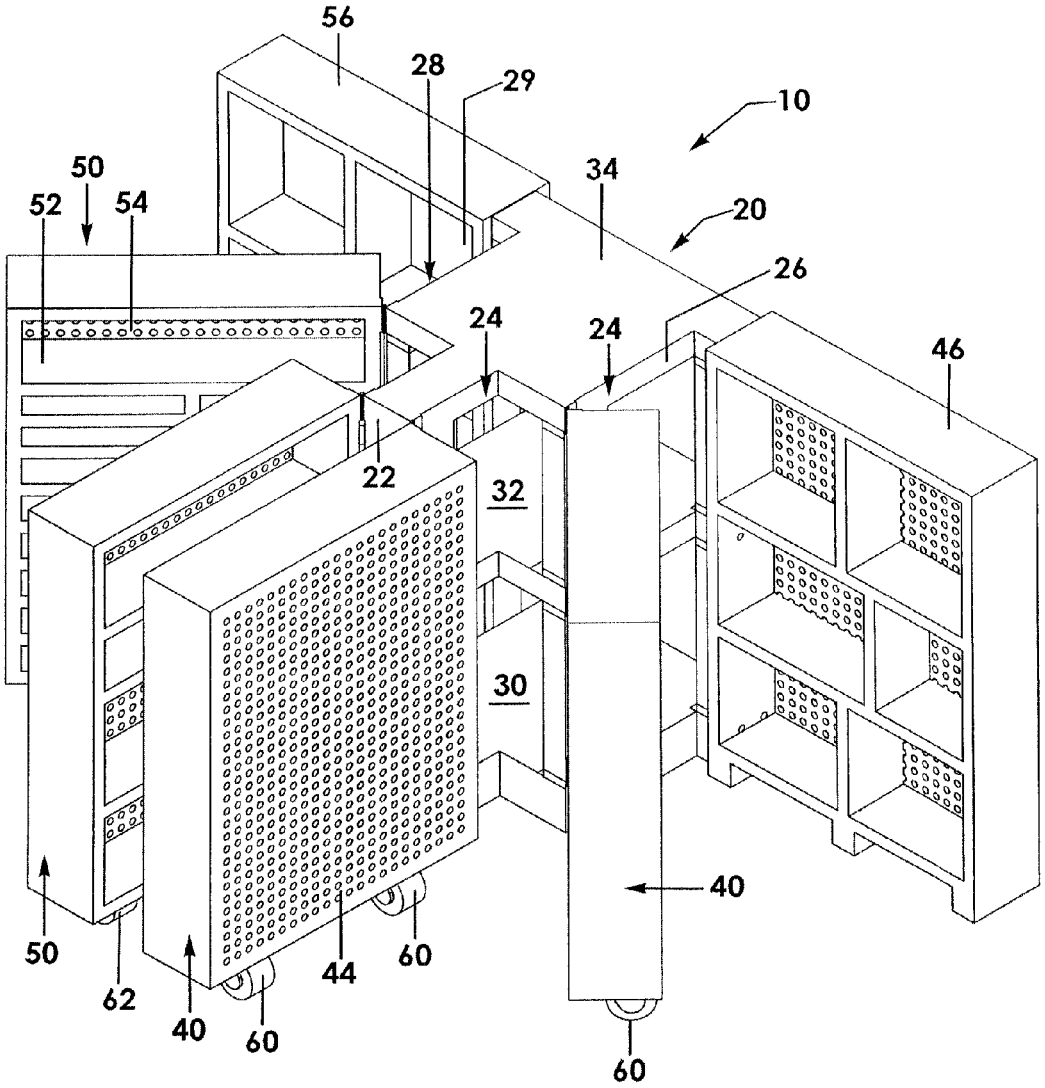
FIG. 1 is a perspective view of an adjustable shelving system according to one embodiment of the present invention illustrated with selected shelf assemblies in forward configurations.

An adjustable shelving system according to a preferred embodiment of the present invention will now be described in detail with reference to FIGS. 1 to 13*b* of the accompanying drawings. The shelving system 10 includes a base member 20 (also referred to as a base shelving unit), a plurality of first shelf assemblies 40 pivotally coupled to a first side 24 of the base member 20, and a plurality of second shelf assemblies 50 pivotally coupled to a second side 28 of the base member 20. One or more rollers may be coupled to a bottom surface of each shelf assembly to facilitate movement thereof. Each shelf assembly may be pivotally coupled to the base member 20 with a floating hinge 70 that enables a respective shelf assembly to float upward or downward as it moves on an uneven floor surface or over a small obstacle.

The base member 20 is a shelving unit having a base portion, intermediate portion, and top portion (FIG. 1). The base member 20 includes a front side, back side, first side 24, and a second side 28 opposed from the first side 24. Each side is open and can be accessed such as to place or remove stored items. The base portion has a planar top surface that may be referred to as a bottom shelf 30. Similarly, the intermediate portion has a planar surface that is upwardly displaced from and parallel to the bottom shelf 30 that may be referred to as an intermediate shelf 32. The top portion also includes a planar upper surface that is upwardly displaced from and parallel to the intermediate shelf 32 that may be referred to as a top shelf 34.

The first side 24 of the base member 20 includes a plurality of graduated first sections 26. Similarly, the second side 28 of the base member 20 includes a plurality of graduated second sections 29. As shown in the drawings, the plurality of corresponding graduated sections is like corresponding stair steps getting narrower toward the front end 22. More particularly, a corresponding pair of first and second sections 26, 29 defines a width that is greater than a width of a forwardly adjacent corresponding pair of first and second sections, 26*a*, 29*a*.

The plurality of first shelf assemblies 40 is pivotally coupled to the first side 24 of the base member 20. More specifically, respective first shelf assemblies 40 are pivotally coupled to respective graduated first sections 26 of the base member 20. In other words, a first shelf assembly 40 is coupled to a respective graduated first section 26. Each first shelf assembly 40 may be pivotally coupled to a respective graduated first section 26 with a hinge 70 as will be further described later. The pivotal connection of the first shelf assembly 40 to a respective section of the first side 24 of the base member 20 defines an imaginary vertical longitudinal axis about which the first shelf assembly 40 is selectively rotated between the first rearward configuration and a first forward configuration.

Preferably, each first shelf assembly 40 is spaced apart from and independently movable relative to each other first shelf assembly 40. Each first shelf assembly 40 is pivotally movable on respective hinges between a first rearward configuration (FIG. 2) generally perpendicular to the respective first side section of the base member 20 and a first forward configuration (FIG. 1) forwardly offset from the first rearward configuration. A first shelf assembly 40 may be pivotally moved all the way to a forward configuration generally parallel to a respective first side section (see forward-most first shelf assembly FIG. 1).

Similarly, the plurality of second shelf assemblies 50 is pivotally coupled to the second side 28 of the base member 20. More specifically, respective second shelf assemblies 50 are pivotally coupled to respective graduated second sections 29 of the base member 20. In fact, a second shelf assembly 50 is coupled to a respective graduated second section 29. Each second shelf assembly 50 may be pivotally coupled to a respective graduated second section 29 with a hinge 70 as will be further described later. The pivotal connection of the second shelf assembly 50 to a respective section of the second side 28 of the base member 20 defines an imaginary vertical longitudinal axis about which the second shelf assembly 50 is selectively rotated between the second rearward configuration and the second forward configuration.

Preferably, each second shelf assembly 50 is spaced apart from and independently movable relative to each other second shelf assembly 50. Each second shelf assembly 50 is pivotally movable on respective hinges between a second rearward configuration (FIG. 2) generally perpendicular to the respective second side section of the base member 20 and a second forward configuration (FIG. 1) forwardly offset from to the second rearward configuration. A second shelf assembly 50 may be pivotally moved all the way to a forward configuration generally parallel to a respective second side section 29 (see forward-most second shelf assembly FIG. 1).

Each first shelf assembly (from the plurality of first shelf assemblies or from the plurality of second shelf assemblies) includes a plurality of vertically spaced apart shelves 42, 52 configured to support articles thereon, for example, in the nature of book shelves. It is understood that each shelf assembly may have a different configuration of shelves than any other shelf assembly although some assemblies may be the same. The shelves are accessible through the open front of respective shelf assemblies. In addition, each shelf assembly may include a sheet of peg board 44, 54 covering a back portion of a respective shelf assembly (FIG. 1). A sheet of peg board may include a plurality of holes configured to receive hook hardware suitable for holding tools or the like.

In an embodiment, the shelving system 10 may include a pair of fixed position shelf assemblies, i.e. that are not pivotal but rather lend stability to the system. More particularly, a first rear shelf assembly 46 is fixedly coupled to the first side 24 of the base member 20 (FIG. 1). Similarly, a second rear shelf assembly 56 is fixedly coupled to the second side 28 of the base member 20. Each rear shelf assembly is generally perpendicular to a respective side (or side section) of the base member 20 and extends outwardly therefrom. In one embodiment, the rear assemblies may have feet, legs, or a flat bottom surface in contact with a floor surface. In another embodiment, the rear assemblies may be mounted to a wall of a room, such as a basement wall or a garage wall of a residence or the like.

Figure 2:
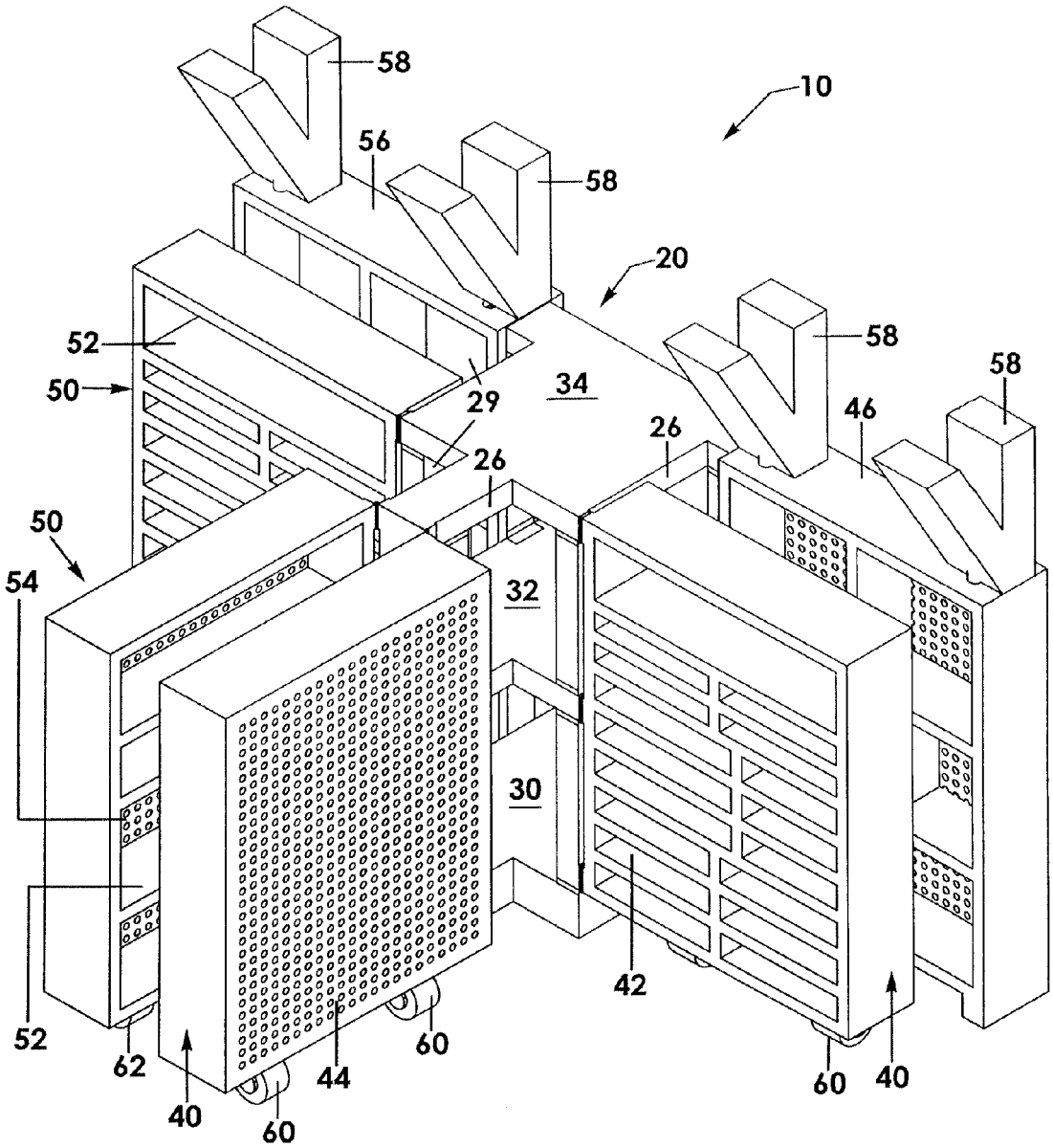
FIG. 2 is another perspective view of the shelving system as in FIG. 1 with selected shelf assemblies in fully forward configurations and others in fully rearward configurations.
Figure 3:
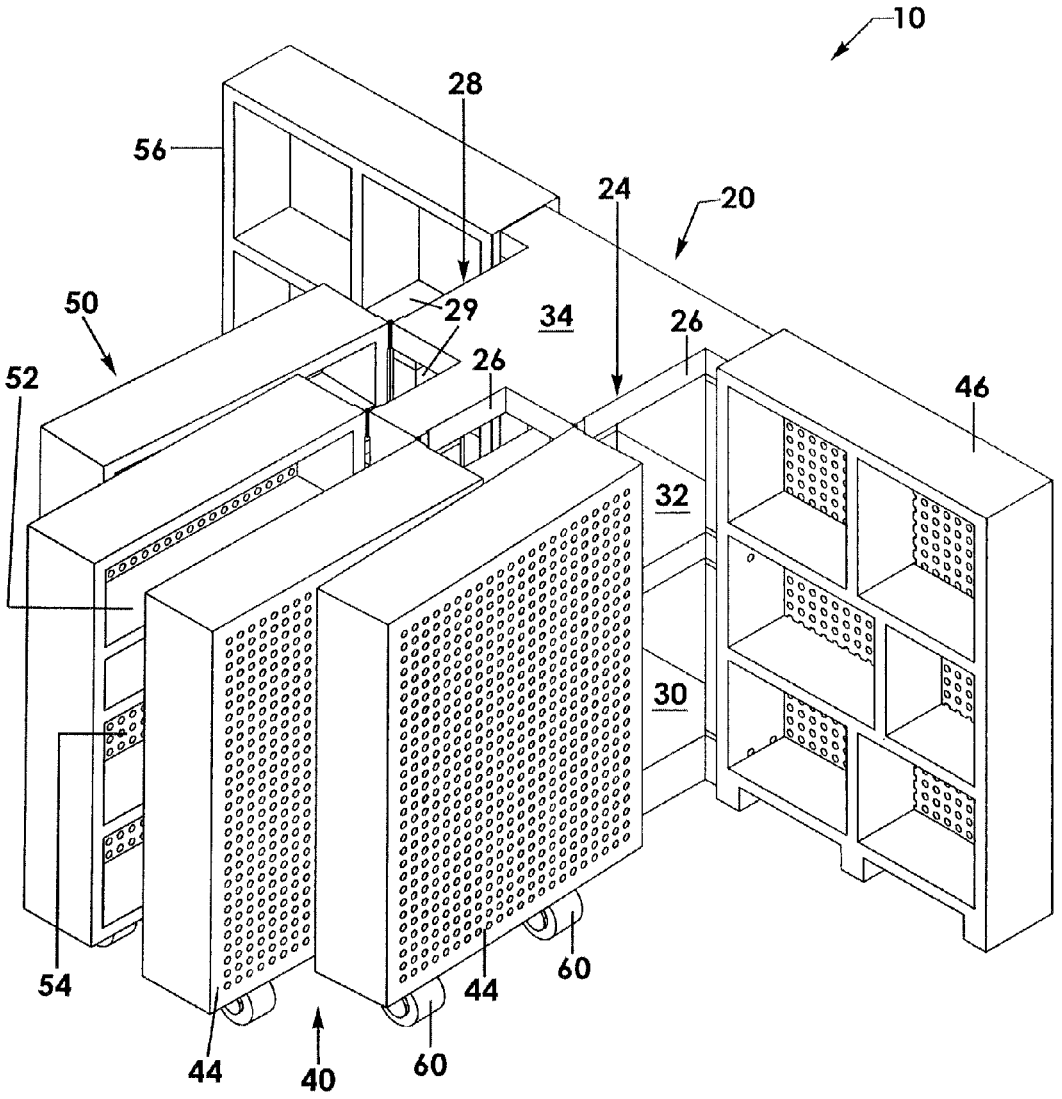
FIG. 3 is another perspective view of the shelving system as in FIG. 1 with all pivotal shelving assemblies in fully forward configurations.
Figure 4:
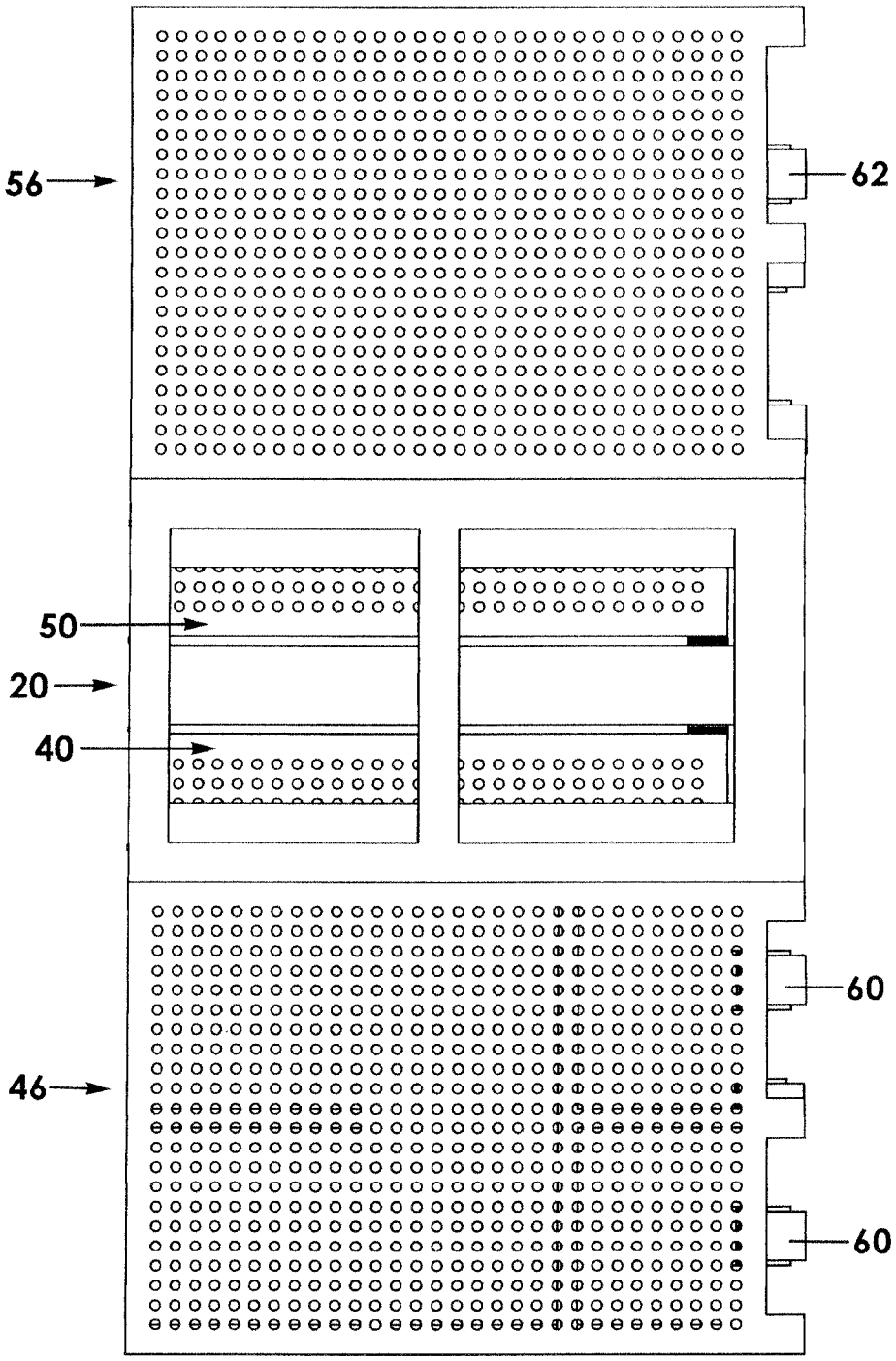
FIG. 4 is a rear view of the shelving system as in FIG. 1.
Figure 5A:
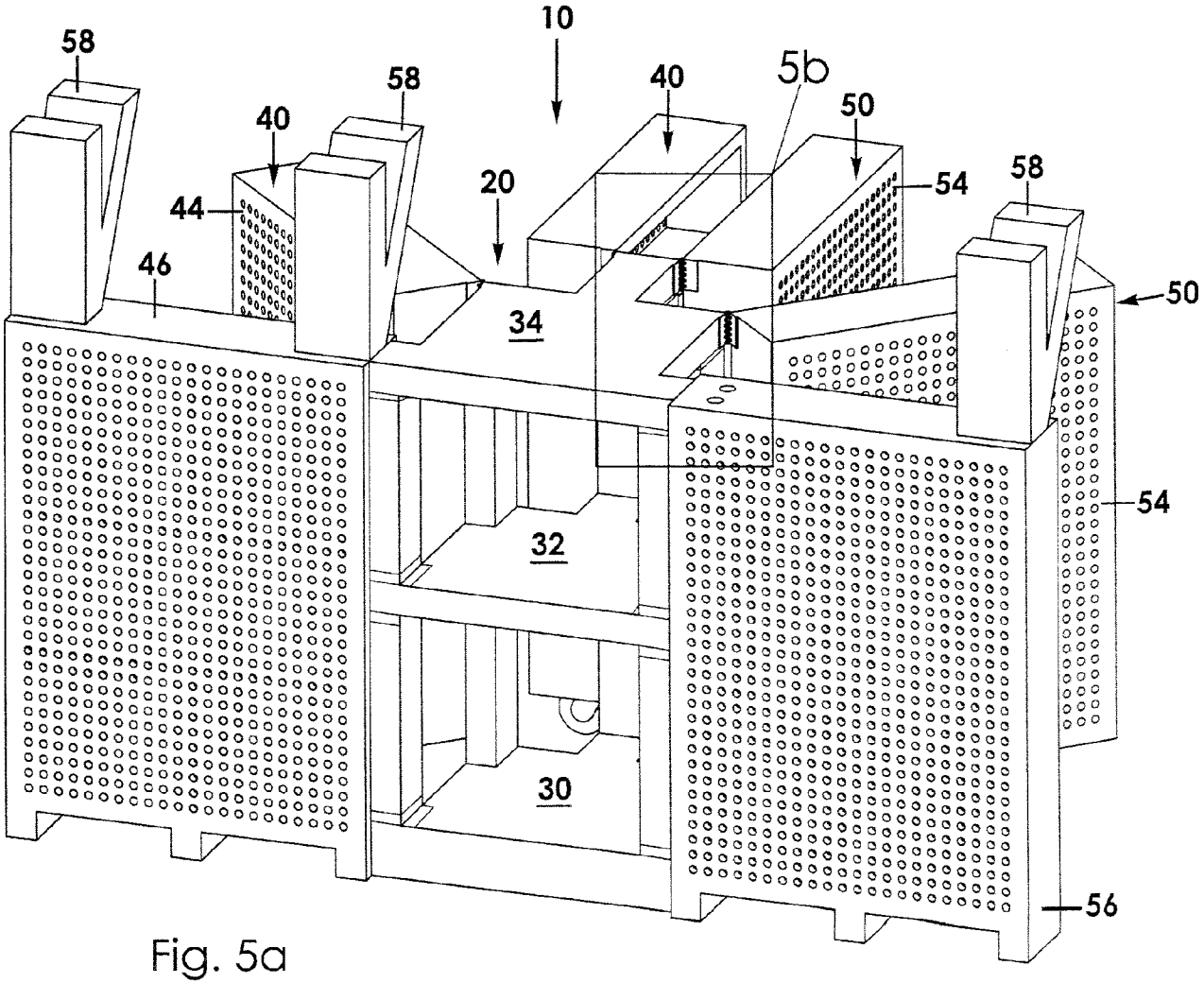
FIG. 5*a* is a perspective rear view of the shelving system as in FIG. 2.
Figure 5B:
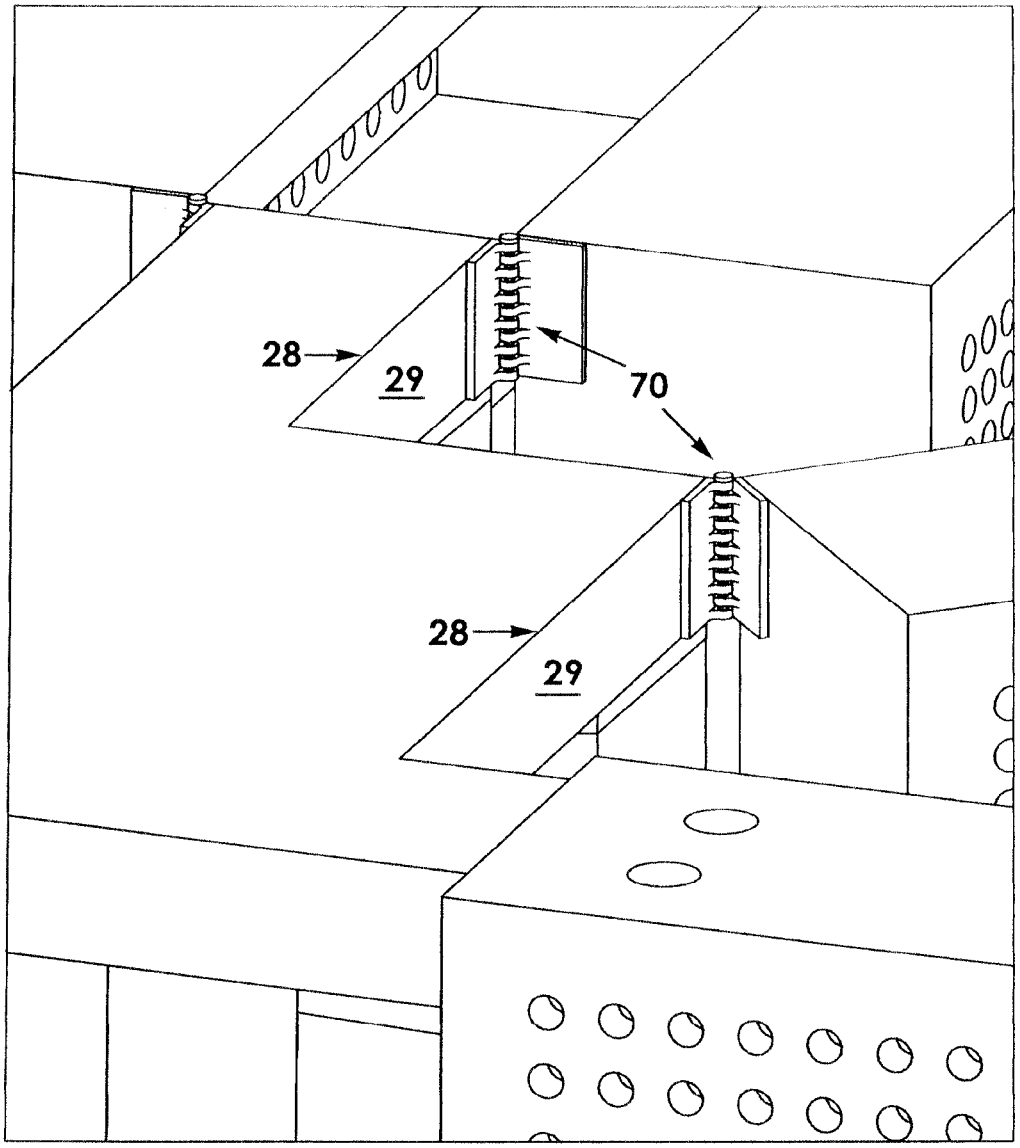
FIG. 5*b* is an isolated view on an enlarged scale taken from a portion of FIG. 5*a;*

In another embodiment, a plurality of ceiling support members 58 is coupled to a top surface of each first rear shelf assembly and to each second rear shelf assembly. The ceiling support members 58 are spaced apart along the top surfaces and extend upwardly (FIG. 2). It is understood that the ceiling support members 58 may be coupled to rafters, a ceiling, or other support structure so as to enhance the stability of the shelving system 10.

Figure 6A:
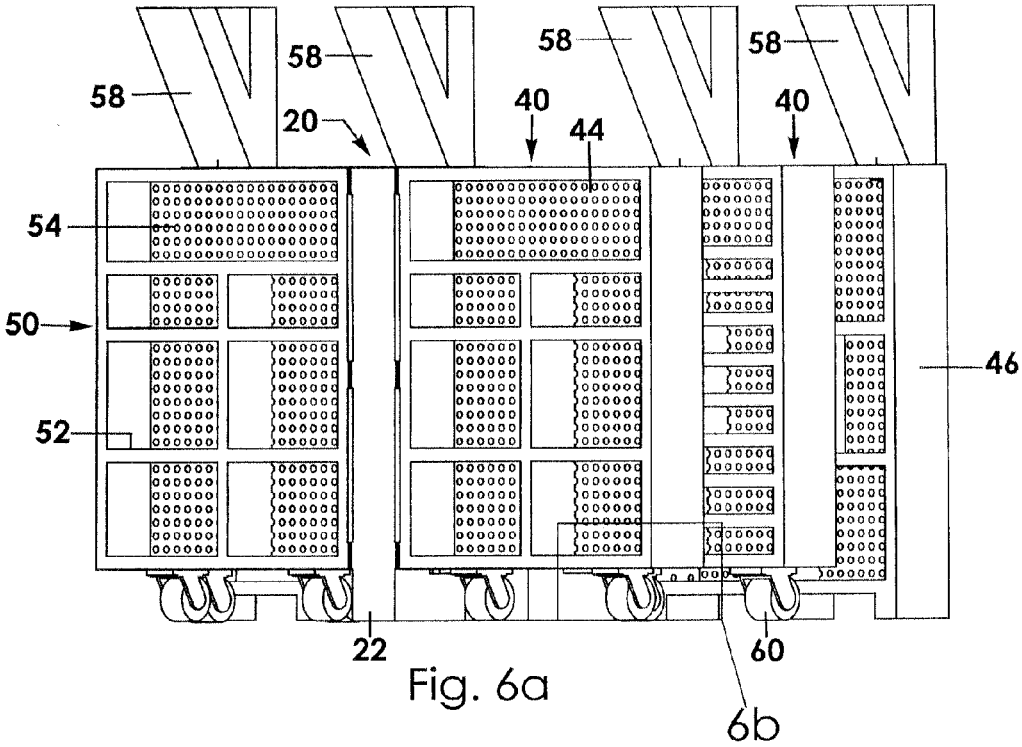
FIG. 6*a* is a front view of the shelving system according to the present invention.
Figure 6B:
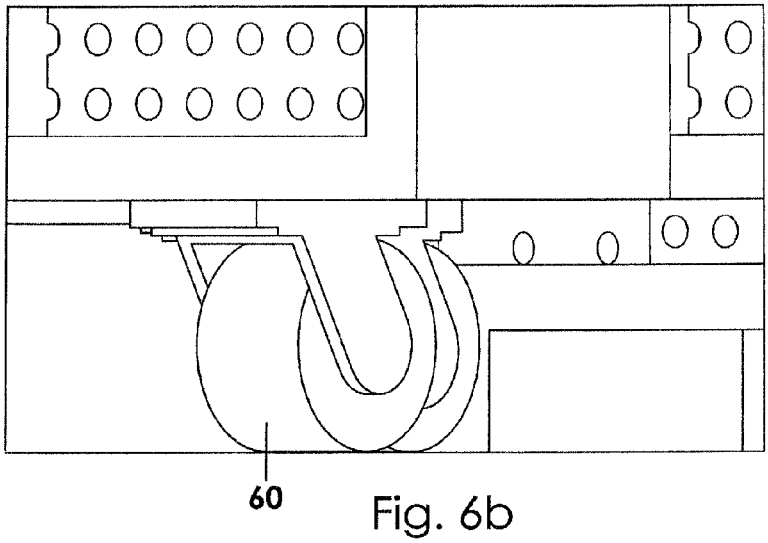
FIG. 6*b* is an isolated view on an enlarged scale taken from a portion of FIG. 6*b;*

In another aspect, each of the plurality of shelf assemblies includes rollers or wheels to enhance and support the pivotal movement thereof described previously. More particularly, at least one first roller 60 is coupled to an underside of each first shelf assembly 40 (FIGS. 6*a* and 6*b*). Each first roller 60 is robust and configured to support a respective first shelf assembly 40 on a floor surface and to provide smooth movement between said first rearward configuration and the first forward configuration. The first rollers 60 are relied upon to support some of the weight of respective first shelf assemblies 40 when floating hinges are used to couple respective first shelf assemblies 40 to the base member 20 as will be described later. Similarly, at least one second roller 62 is coupled to an underside of each second shelf assembly 50 (FIGS. 6*a* and 6*b*). The function of each second roller 62 is the same as that of each first roller 60 and need not be explained in detail.

As disclosed earlier, each shelf assembly (first or second) may be pivotally coupled to a respective side of the base member 20 with a hinge 70. Preferably, the hinge 70 used in the preferred embodiment is a vertically floating hinge shown particularly in FIGS. 7*a* to 8*b*. References to the hinge 70 and the "floating hinge" will hereafter be made using the same reference numeral 70. The floating hinge 70 is configured to enable an attached shelf assembly to move upward if a corresponding roller rolls onto a raised surface or, conversely, to enable an attached shelf assembly to move downward if a corresponding roller rolls into a recessed surface. This configuration alleviates the strain on the hinges so as to reduce failures or damage thereto.

Figure 8A:
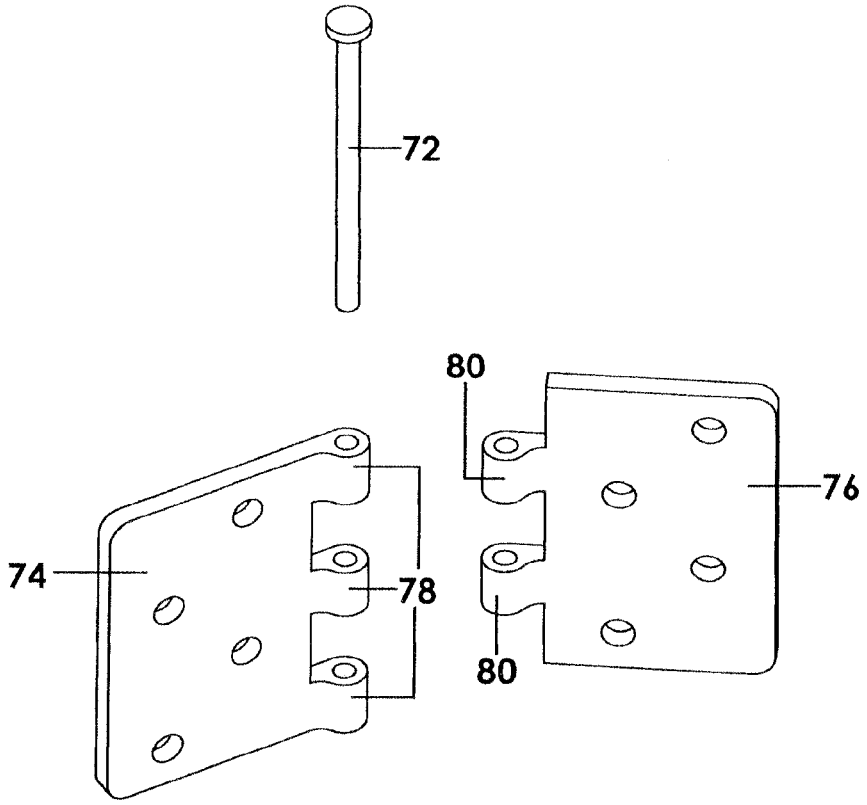
FIG. 8*a* is an exploded view of the floating hinge as in FIG. 7*a;*

The floating hinge 70 includes a pin 72 having an elongate and linear configuration as is common to hinges (FIG. 8*a*). The floating hinge 70 also includes a first leaf 74 having at least a pair of space apart "first-leaf knuckles" 78 rotatably coupled to the pin 72 and configured so that the first leaf 74 is selectively rotatable about the pin 72. It is understood that this movement is how a respective shelf assembly is rotatable relative to the base member 20. By way of example, the first leaf 74 would be attached to a respective side of the base member. The floating hinge 70 includes a second leaf 76 having at least one second-leaf knuckle 80 rotatably coupled to the pin 72 and situated between the pair of spaced apart first-leaf knuckles 78.

Figure 7A:
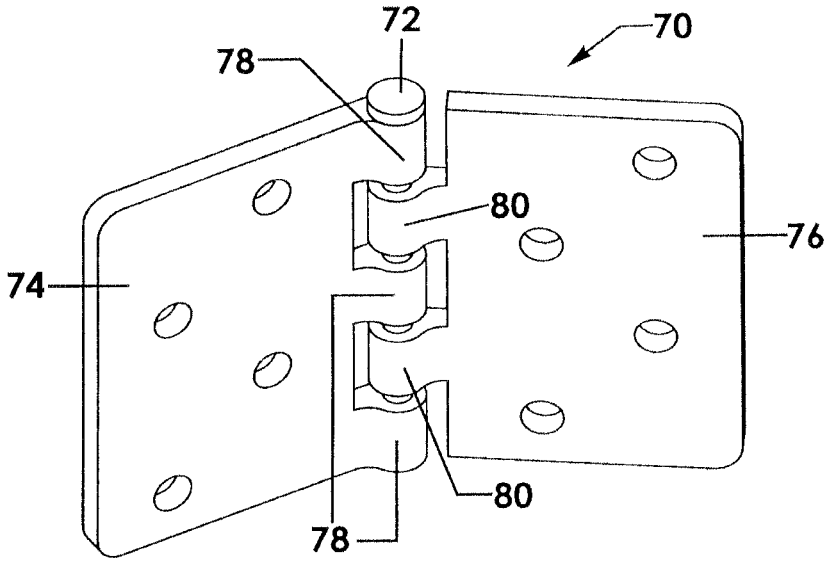
FIG. 7*a* is a perspective view of a floating hinge illustrated in a neutral configuration.
Figure 7B:
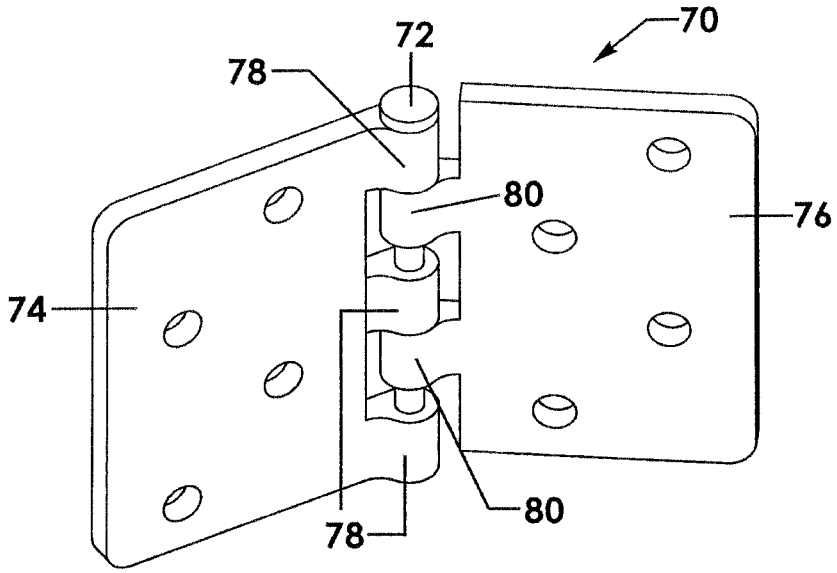
FIG. 7*b* is a perspective view of the floating hinge as in FIG. 7*a* illustrated in a raised configuration.
Figure 8B:
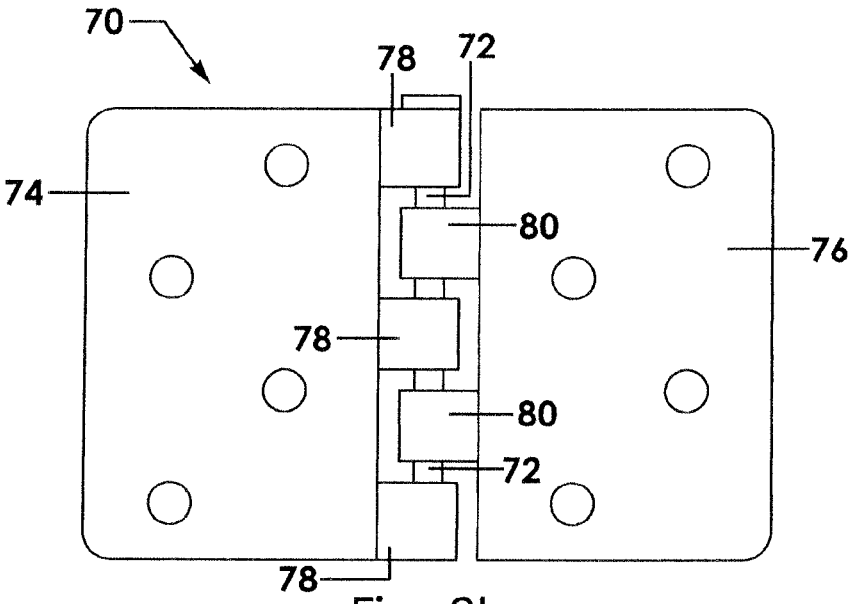
FIG. 8*b* is a front view of the floating hinge as in FIG. 7*a.*

The second-leaf knuckle 80 is configured to slide along the pin 72 between the pair of spaced apart first-leaf knuckles 78. Even more particularly, the second-leaf knuckle 80 is configured to slide up and down along the pin 72 between the pair of spaced apart first-leaf knuckles 78. To accomplish this configuration, the second-leaf knuckle 80 is smaller than the space between the pair of first-leaf knuckles 78. FIGS. 7*b* and 8*b* may be compared to understand how the first leaf 74 and second leaf 76 are adjusted vertically relative to one another.

The first leaf 74 would be fixedly attached to the first side 24 of the base member 20 while the second leaf 76 would be fixedly attached to a respective first shelf assembly 40. When the first shelf assembly 40 is swinging/pivoting as described above and the corresponding first roller 60 rolls upon an obstacle or the floor surface inclines, the second leaf 76 is urged upwardly along the hinge pin 72 and the entire respective first shelf assembly 40 is moved upwardly. When the first roller 60 rolls down from the obstacle or the floor surface levels out, the second leaf 76 is naturally urged downwardly along the hinge pin 72. It can be seen that the floating hinge 70 relieves the strain that would be put on a traditional hinge 70 experienced by rotating without the support of a roller and without the ability to adjust vertically as a result of obstacles or uneven surfaces.

An adjustable shelving unit 100 according to another embodiment of the present invention and shown in FIGS. 9*a* to 13*b* is substantially similar to the embodiment described above except as specifically noted below. The adjustable shelving unit 100 includes a base member having a different configuration than the base member 20 described previously and will, as a result, be referred to with different reference numerals. The additional structures of the adjustable shelving unit 100 are substantially similar to corresponding structures described above and will be referenced using the same reference numerals as referenced previously.

More particularly, the base member 102 according to the embodiment shown in FIGS. 9*a* to 13*b* is not rectangular or graduated as described previously. Rather, the base member 102 has three side portions arranged in a generally triangular configuration. The base member 102 includes a rear portion 104 having a first end 106 and an opposed second end 108 that create a generally linear configuration. A first side portion 110 includes a proximal end 112 fixedly coupled to the first end 106 of the rear portion 104, the first side portion 110 extending away from the rear portion 104 to an opposed distal end 114. Likewise, a second side portion 116 includes a proximal end 118 fixedly coupled to the second end 108 of the rear portion, the second side portion 116 extending away from the rear portion 104 to a distal end 120. Respective distal ends 114, 120 of the first side portion 110 and the second side portion 116 are coupled together. Preferably, the first side portion 110 and the second side portion 116 have the same length and extend away from respective ends of the rear portion 104 at the same angle so that the configuration of the base member 102 is that of an isosceles triangle. In such case, the rear portion 104 has a length that is greater than a length of the first and second side portions. It is understood that the base member 102 may include more than one elevated section as described previously and, therefore, include multiple levels of the rear portion 104, the first side portion 110, and the second side portion 116.

Figure 9A:
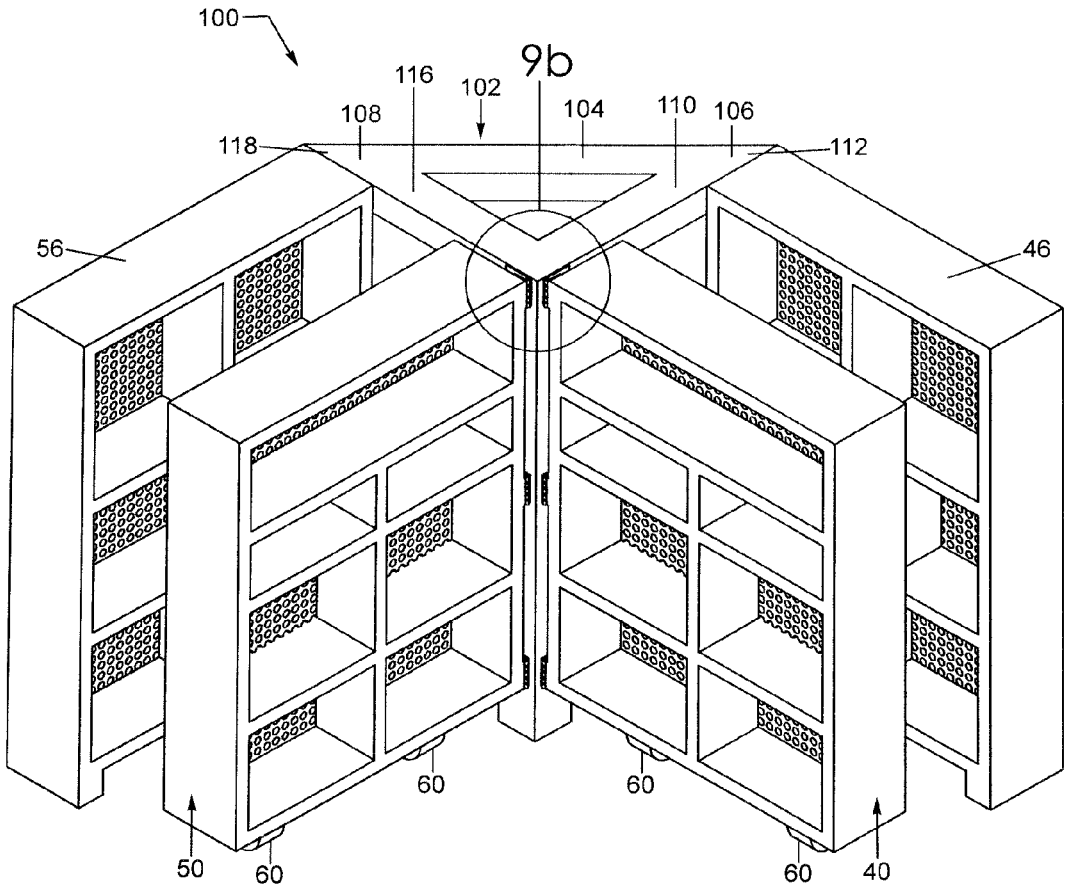
FIG. 9*a* is a perspective view of an adjustable shelving system according to a another embodiment of the present invention illustrated with first and second shelf assemblies in rearward configurations.
Figure 9B:
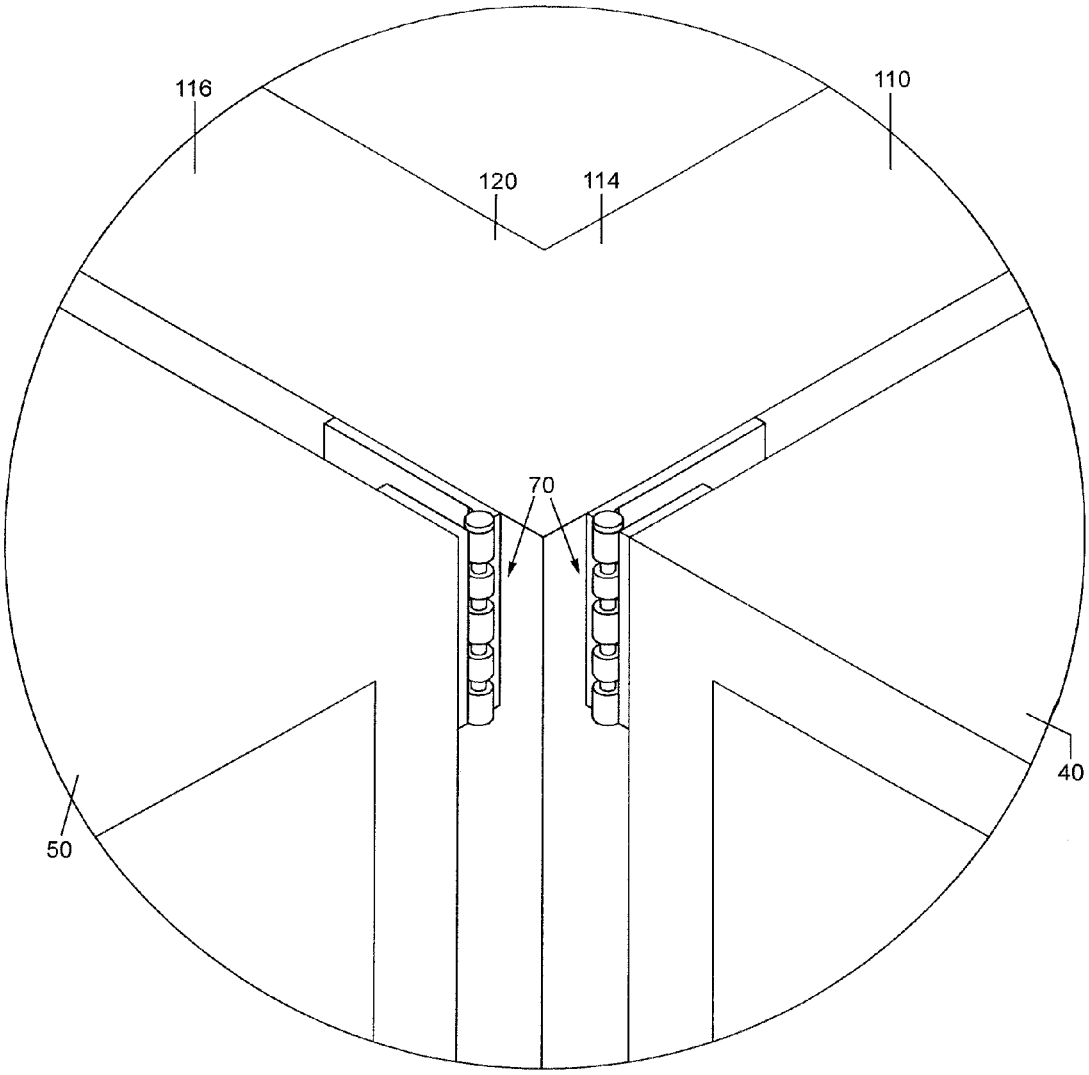
FIG. 9*b* is an isolated view on an enlarged scale taken from FIG. 9*a;*
Figure 10:
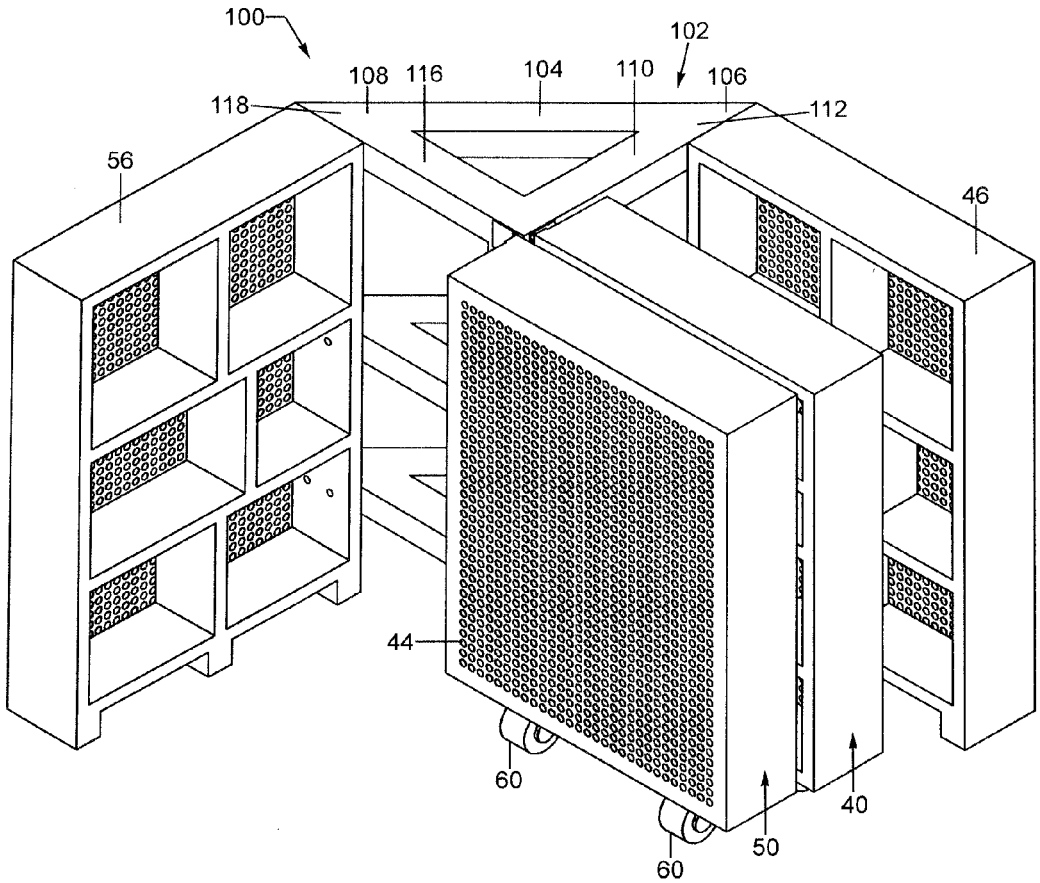
FIG. 10 is a perspective view of the adjustable shelving system as in FIG. 9*a* with one shelving assembly in a forward configuration and one shelving assembly in a rearward configuration.
Figure 11:
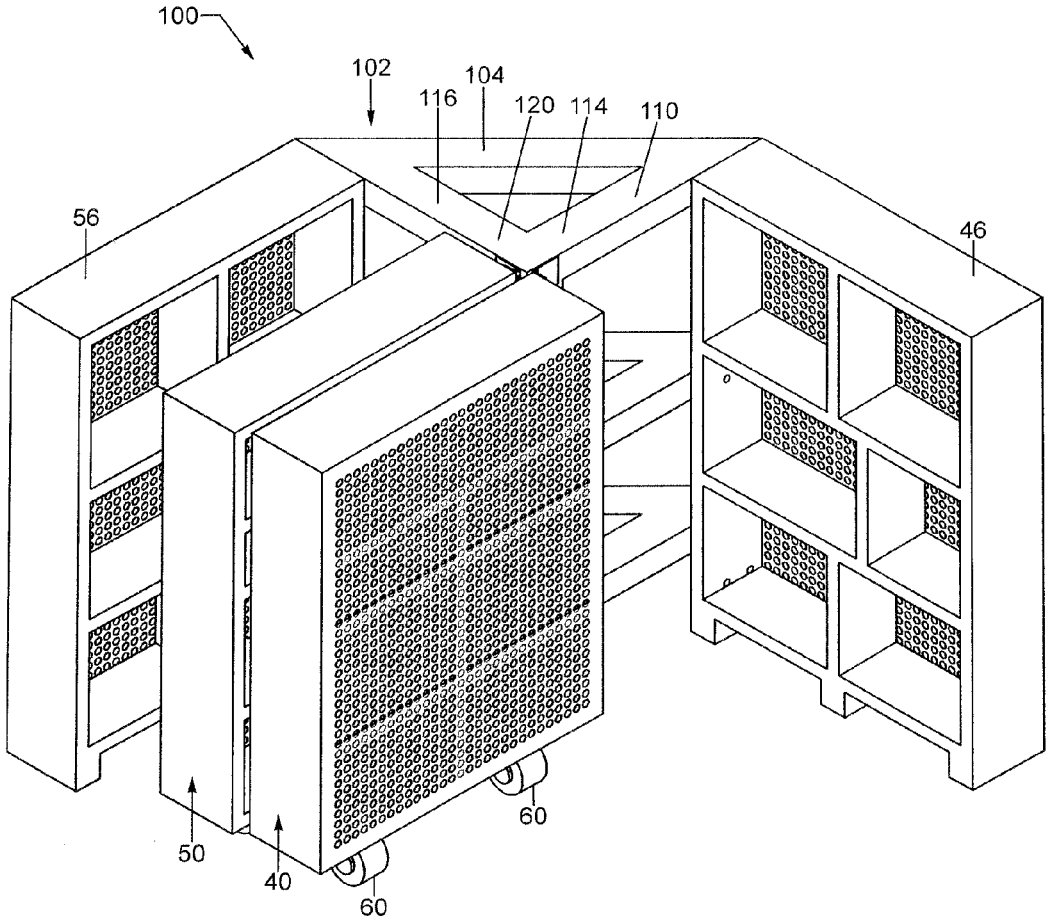
FIG. 11 is a perspective view of the adjustable shelving system as in FIG. 10 with the shelving assemblies in reversed configurations.
Figure 12A:
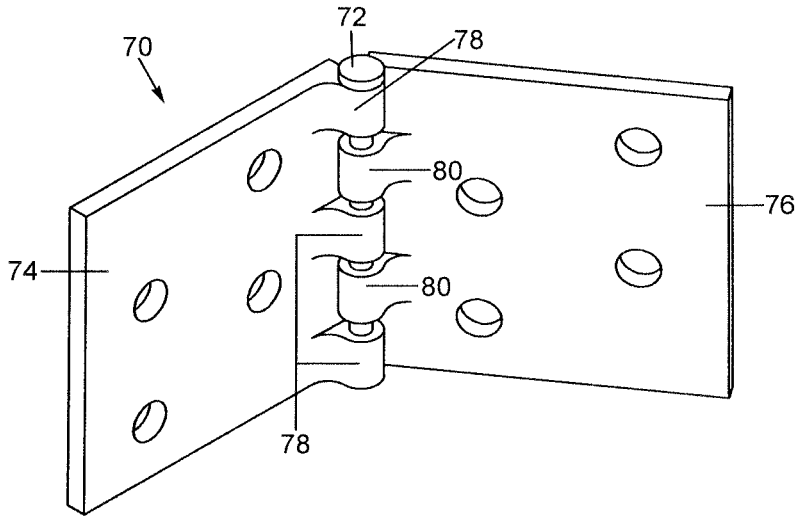
FIG. 12*a* is a perspective view of a floating hinge illustrated in a neutral configuration.
Figure 12B:
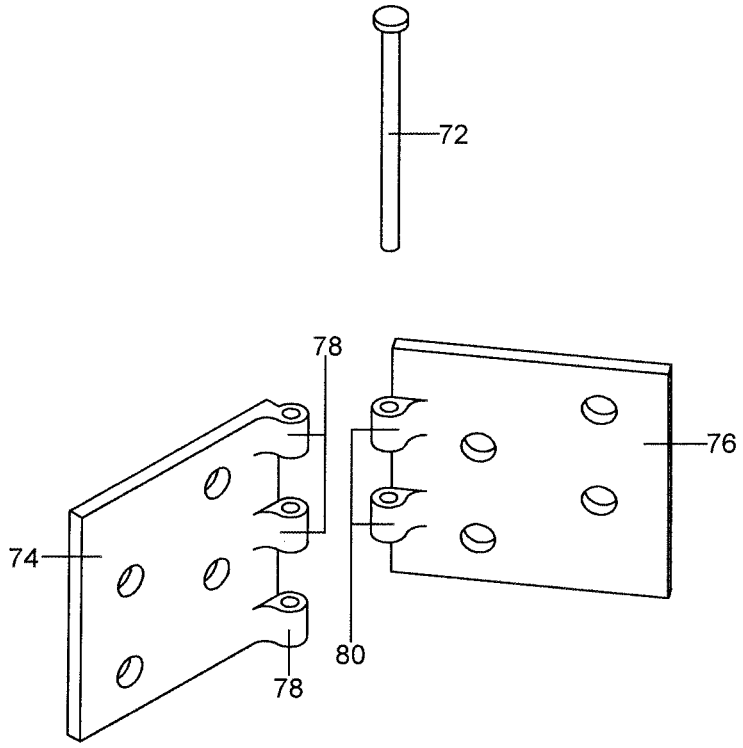
FIG. 12*b* is a perspective view of the floating hinge as in FIG. 12*a* illustrated in a raised configuration.
Figure 13A:
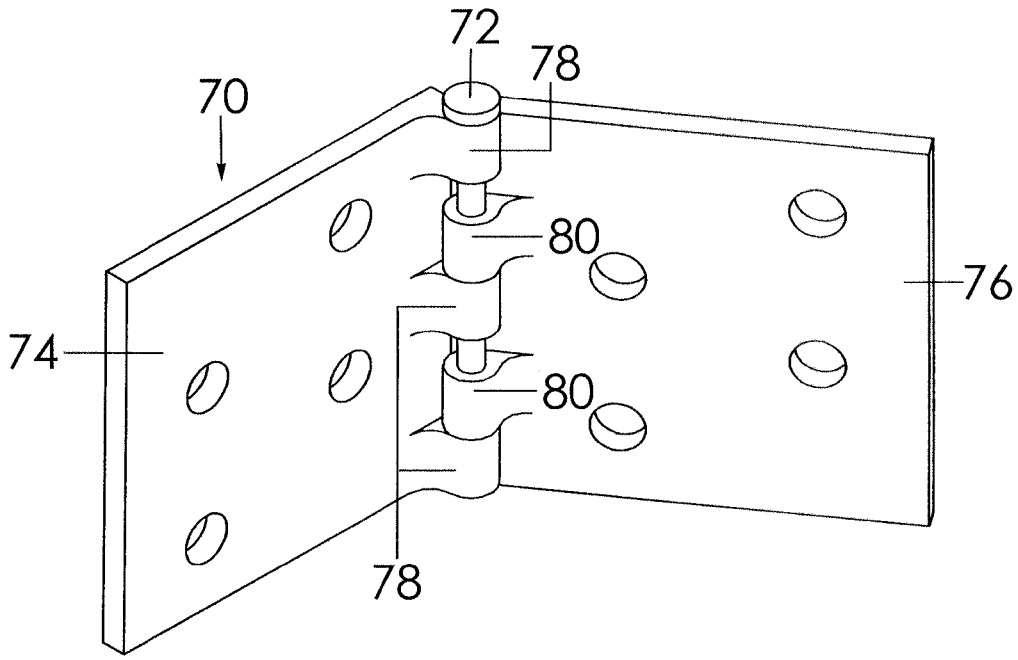
FIG. 13*a* is an exploded view of the floating hinge as in FIG. 12*a;*
Figure 13B:
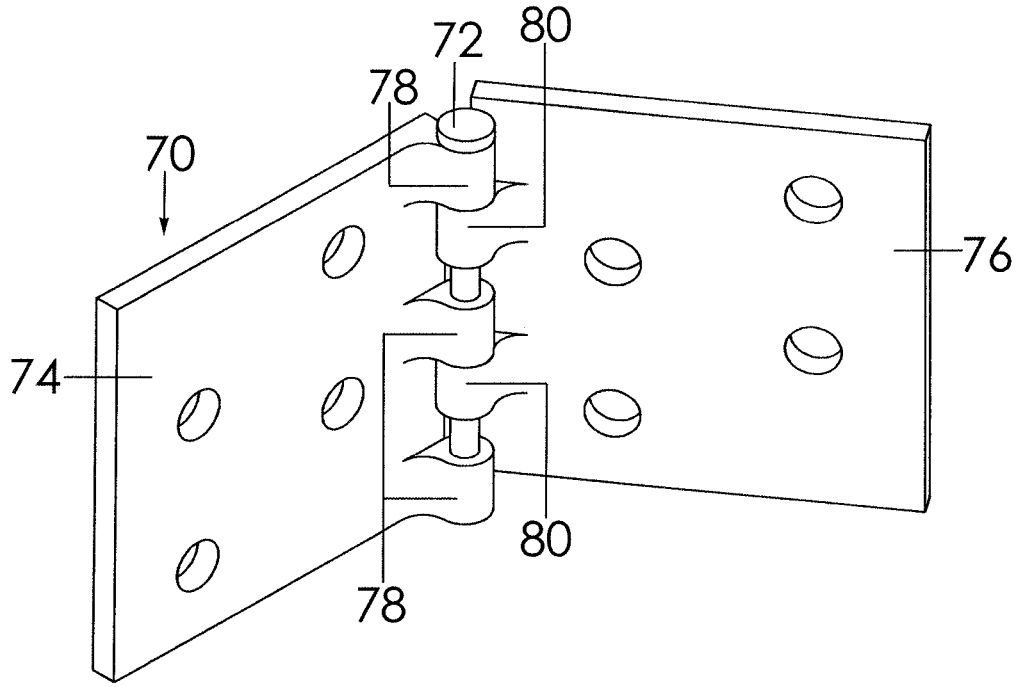
FIG. 13*b* is a front view of the floating hinge as in FIG. 12*a.*

As shown in FIG. 9*a*, a first shelf assembly 40 is pivotally coupled to an outer edge of the first side portion 110 and is pivotally movable between a first rearward configuration generally perpendicular to the first side portion 110 (FIG. 9*a*) and a first forward configuration forwardly offset therefrom (FIG. 11). It is understood that the first shelf assembly 40 may be similarly coupled to corresponding outer edges of each elevated and vertically spaced apart section of the first side portion 110. Similarly, a second shelf assembly 50 is pivotally coupled to an outer edge of the second side portion 116 and is pivotally movable between a second rearward configuration generally perpendicular to the second side portion 116 (FIG. 9*a*) and a second forward configuration forwardly offset therefrom (FIG. 10). While only a single first shelf assembly 40 and single second shelf assembly 50 are illustrated, it is understood that a plurality of respective shelf assemblies may be included in some embodiments.

In addition, a first rear shelf assembly 46 and second rear shelf assembly 56 may be coupled to respective outer edges of respective first and second side portions in the manner described previously. Uniquely, however, the three-sided configuration of the base member 102 enables each of the first rear shelf assembly 46 and the second rear shelf assembly 56 to be parallel with walls of a structure (such as a house or building) that are generally perpendicular to one another, such as in a corner.

In use, respective shelf assemblies may be selectively pivoted between rearward configurations at which articles may be accessed on respective shelves and forward configurations at which tools or other articles may be stored or accessed on respective peg boards. The configuration of multiple shelf assemblies pivotally coupled to the base member 20 maximizes the amount of storage and minimizes the amount of floor space required to accomplish the storage benefits.

It is understood that while certain forms of this invention have been illustrated and described, it is not limited thereto except insofar as such limitations are included in the following claims and allowable functional equivalents thereof.

The invention claimed is:

1. An adjustable shelving system, comprising:

an upstanding base member having a rear portion, a first side portion having a proximal end coupled to first end of said rear portion, and a second side portion having a proximal end coupled to a second end of said rear portion;

wherein said first side portion includes a distal end coupled to a distal end of said second side portion;

a first shelf assembly pivotally coupled to said first side portion of said base member, said first shelf assembly being movable between a first rearward configuration generally perpendicular to said first side portion of said base member and a first forward configuration forwardly offset relative to said rearward configuration;

a second shelf assembly pivotally coupled to said second side portion of said base member, said second shelf assembly being movable between a second rearward configuration generally perpendicular to said second side portion of said base member and a second forward configuration forwardly offset relative to said rearward configuration;

a plurality of first rollers, at least one first roller being coupled to an underside of said first shelf assembly and configured to support said first shelf assembly on a floor surface and to enhance movement between said first rearward configuration and said first forward configuration; and a plurality of second rollers, at least one second roller being coupled to an underside of said second shelf assembly and configured to support said second shelf assembly on a floor surface and to enhance movement between said second rearward configuration and said second forward configuration.

2. The shelving system as in claim 1, wherein:

said base member defines a triangular configuration;

said first side portion and said second side portion are of equal length between respective proximal and distal ends.

3. The shelving system as in claim 1, wherein:

said first shelf assembly is pivotally connected to said first side portion of said base member and defines a longitudinal axis about which said first shelf assembly is selectively rotated between said first rearward configuration and said first forward configuration; and said second shelf assembly is pivotally connected to said second side portion of said base member and defines a longitudinal axis about which said second shelf is selectively rotated between said second rearward configuration and said second forward configuration.

4. The shelving system as in claim 1, wherein:

said first shelf is pivotally connected to said first side portion of said base member and defines a longitudinal axis about which each said first shelf is selectively rotated between said first rearward configuration and said first forward configuration; and said second shelf is pivotally connected to said second side portion of said base member and defines a longitudinal axis about which each said second shelf is selectively rotated between said second rearward configuration and said second forward configuration.

5. The shelving system as in claim 4, wherein:

said first shelf assembly is parallel to said first side portion of said base member at said first forward configuration; and said second shelf assembly is parallel to said second side portion of said base member at said second forward configuration.

6. The shelving system as in claim 1, wherein:

said first shelf assembly includes a plurality of vertically spaced apart shelves configured to support articles thereon;

said second shelf assembly includes a plurality of vertically spaced apart shelves configured to support articles thereon;

said first shelf assembly includes a first sheet of pegboard coupled to a rear portion thereof; and said second shelf assembly includes a second sheet of pegboard coupled to a rear portion thereof.

7. The shelving system as in claim 1, comprising:

a first rear shelf assembly fixedly coupled to said first side portion of said base member that is generally perpendicular to said first side portion and extends away therefrom; and a second rear shelf assembly fixedly coupled to said second side portion of said base member that is generally perpendicular to said second side portion and extends away therefrom.

8. The shelving system as in claim 7, wherein:

said first rear shelf assembly is situated adjacent said proximal end of said first side portion and adjacent said first end of a rear wall of said base member;

said second rear shelf assembly is situated adjacent said proximal end of said second side wall and adjacent said opposed end of a rear wall of said base member.

9. The shelving system as in claim 1, wherein:

said first shelf assembly is pivotally coupled to said first side portion of said base member with a hinge; and said second shelf assembly is pivotally coupled to said second side portion of said base member with a hinge.

10. The shelving system as in claim 9, wherein:

said first shelf assembly is pivotally coupled to said first side portion of said base member with a hinge; and said second shelf assembly is pivotally coupled to said second side portion of said base member with a hinge.

11. The shelving system as in claim 10, wherein said hinge is a vertically floating hinge including:

a pin having a linear configuration;

a first leaf having at least a pair of spaced apart first-leaf knuckles rotatably coupled to said pin; and a second leaf having at least one second-leaf knuckle rotatably coupled to said pin, said second-leaf knuckle situated between said pair of spaced apart first-leaf knuckles and configured to slide along said pin between said pair of spaced apart first-leaf knuckles.

12. The shelving system as in claim 9, wherein:

said hinge is a vertically floating hinge;

said first shelf assembly is pivotally coupled to said first side portion of said base member with said vertically floating hinge;

said second shelf assembly is pivotally coupled to said second side portion of said base member with said vertically floating hinge;

wherein said vertically floating hinge includes:

a pin having a linear configuration;

a first leaf having at least a pair of spaced apart first-leaf knuckles rotatably coupled to said pin; and a second leaf having at least one second-leaf knuckle rotatably coupled to said pin, said second-leaf knuckle situated between said pair of spaced apart first-leaf knuckles and configured to slide along said pin between said pair of spaced apart first-leaf knuckles.

13. The shelving system as in claim 1, wherein:

said first shelf assembly is pivotally coupled to said first side portion of said base member with a vertically floating hinge;

said second shelf assembly is pivotally coupled to said second side portion of said base member with a vertically floating hinge;

wherein said vertically floating hinge includes:

a pin having a linear configuration;

a first leaf having at least a pair of spaced apart first-leaf knuckles rotatably coupled to said pin; and a second leaf having at least one second-leaf knuckle rotatably coupled to said pin, said second-leaf knuckle situated between said pair of spaced apart first-leaf knuckles and configured to slide along said pin between said pair of spaced apart first-leaf knuckles.

14. An adjustable shelving system, comprising:

an upstanding base member having a rear portion, a first side portion having a proximal end coupled to first end of said rear portion, and a second side portion having a proximal end coupled to a second end of said rear portion;

wherein said first side portion includes a distal end coupled to a distal end of said second side portion;

a first shelf assembly pivotally coupled to said first side portion of said base member, said first shelf assembly being movable between a first rearward configuration generally perpendicular to said first side portion of said base member and a first forward configuration forwardly offset relative to said rearward configuration; and a second shelf assembly pivotally coupled to said second side portion of said base member, said second shelf assembly being movable between a second rearward configuration generally perpendicular to said second side portion of said base member and a second forward configuration forwardly offset relative to said rearward configuration;

wherein said base member is a base shelving unit having a bottom shelf, an intermediate shelf upwardly displaced from said bottom shelf, and an upper shelf upwardly displaced from said intermediate shelf.

15. The shelving system as in claim 14, wherein said base shelving unit defines an open front, an open first side, and an open second side.

16. The shelving system as in claim 11, wherein said base member is a base shelving unit having a bottom shelf, an intermediate shelf upwardly displaced from said bottom shelf, and an upper shelf upwardly displaced from said intermediate shelf.

* * * * *